US012268238B2

(12) United States Patent
Lomas et al.

(10) Patent No.: US 12,268,238 B2
(45) Date of Patent: Apr. 8, 2025

(54) SMOKING SUBSTITUTE DEVICE

(71) Applicant: Imperial Tobacco Limited, Bristol (GB)

(72) Inventors: Peter Lomas, Liverpool (GB); Chris Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 668 days.

(21) Appl. No.: 17/389,754

(22) Filed: Jul. 30, 2021

(65) Prior Publication Data

US 2021/0352965 A1 Nov. 18, 2021

Related U.S. Application Data

(63) Continuation of application No. PCT/EP2020/051123, filed on Jan. 17, 2020.

(51) Int. Cl.
*A24F 40/42* (2020.01)
*A24F 40/10* (2020.01)
*A24F 40/44* (2020.01)

(52) U.S. Cl.
CPC ..... *A24F 40/42* (2020.01); *A24F 40/10* (2020.01); *A24F 40/44* (2020.01)

(58) Field of Classification Search
CPC ..... A24F 40/42; A24F 40/10; A24F 40/44
See application file for complete search history.

(56) References Cited

U.S. PATENT DOCUMENTS

2017/0340011 A1* 11/2017 Batista ..... A24F 40/44
2018/0242642 A1* 8/2018 Silvesstrini ..... H05B 1/0227
2018/0317559 A1 11/2018 Qiu

FOREIGN PATENT DOCUMENTS

KR 200482800 Y1 * 10/2014 ..... A24F 47/00
WO WO 2017/141017 8/2017
WO WO 2017/176111 10/2017

OTHER PUBLICATIONS

English language machine translation of Hwang Il-young (KR 200482800 Y1) (Year: 2014).*
International Search Report and Written Opinion (PCT/EP2020/051123 ); May 4, 2020.

* cited by examiner

*Primary Examiner* — Christopher M Rodd
*Assistant Examiner* — Adam Z Baratz
(74) *Attorney, Agent, or Firm* — DUNLAP CODDING, P.C.

(57) ABSTRACT

A consumable for a smoking substitute device. The consumable comprising: a heating device, for heating a vapourisable liquid; an electrical contact, for connecting to a power supply terminal of the smoking substitute device; and a boss, located adjacent to the electrical contact. The boss resists physical deformation of the electrical contact when the electrical contact is connected to the power supply terminal of the smoking substitute device.

7 Claims, 4 Drawing Sheets

110
150
120

122
128
120
126
124

152
150
158
156
154

SMOKING SUBSTITUTE DEVICE

CROSS-REFERENCE TO RELATED APPLICATIONS

The present patent application claims priority to international patent application no. PCT/EP2020/051123, filed on Jan. 17, 2020, which claims priority to the patent application identified by 19155047.4 filed on Feb. 1, 2019 in the European regional office. The entire contents of both patent applications are hereby incorporated herein by reference.

FIELD OF THE DISCLOSURE

The present disclosure relates to smoking substitute devices, and particularly, although not exclusively, to providing smoking substitute devices with flexible seals located at a connection between a main body of the smoking substitute device and a consumable.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices, which may also be known as electronic nicotine delivery systems, may comprise electronic systems that permit a user to simulate the act of smoking by producing an aerosol, also referred to as a "vapour", which is drawn into the lungs through the mouth (inhaled) and then exhaled. The inhaled aerosol typically bears nicotine and/or flavourings without, or with fewer of, the odour and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilising a different smoking substitute approach. A smoking substitute approach corresponds to the manner in which the substitute system operates for a user.

One approach for a smoking substitute device is the so-called "vaping" approach, in which a vapourisable liquid, typically referred to (and referred to herein) as "e-liquid", is heated by a heating device to produce an aerosol vapour which is inhaled by a user. An e-liquid typically includes a base liquid as well as nicotine and/or flavourings. The resulting vapour therefore typically contains nicotine and/or flavourings. The base liquid may include propylene glycol and/or vegetable glycerin.

A typical vaping smoking substitute device includes a mouthpiece, a power source (typically a battery), a tank for containing e-liquid, as well as a heating device. In use, electrical energy is supplied from the power source to the heating device, which heats the e-liquid to produce an aerosol (or "vapour") which is inhaled by a user through the mouthpiece.

Vaping smoking substitute devices can be configured in a variety of ways. For example, there are "closed system" vaping smoking substitute devices which typically have a sealed tank and heating element which is pre-filled with e-liquid and is not intended to be refilled by an end user. One subset of closed system vaping smoking substitute devices include a main body which includes the power source, wherein the main body is configured to be physically and electrically coupled to a consumable including the tank and the heating element. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the myblu® e-cigarette. The myblu® e-cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heating device, which for this device is a heating filament coiled around a portion of a wick which is partially immersed in the e-liquid. The device is activated when a microprocessor on board the main body detects a user inhaling through the mouthpiece.

When the device is activated, electrical energy is supplied from the power source to the heating device, which heats e-liquid from the tank to produce a vapour which is inhaled by a user through the mouthpiece.

Another example vaping smoking substitute device is the blu PRO® e-cigarette. The blu PRO® e-cigarette is an open system device which includes a main body, a (refillable) tank, and a mouthpiece. The main body and tank are physically and electrically coupled together by screwing one to the other. The mouthpiece and refillable tank are physically coupled together by screwing one into the other, and detaching the mouthpiece from the refillable tank allows the tank to be refilled with e-liquid. The device is activated by a button on the main body. When the device is activated, electrical energy is supplied from the power source to a heating device, which heats e-liquid from the tank to produce a vapour which is inhaled by a user through the mouthpiece.

Another approach for a smoking substitute device is the so-called "heat not burn" ("HNB") approach in which tobacco (rather than e-liquid) is heated or warmed to release vapour. The tobacco may be leaf tobacco or reconstituted tobacco. The vapour may contain nicotine and/or flavourings. In the HNB approach the intention is that the tobacco is heated but not burned, i.e. does not undergo combustion.

A typical HNB smoking substitute device may include a main body and a consumable. The consumable may include the tobacco material. The main body and consumable may be configured to be physically coupled together. In use, heat may be imparted to the tobacco material by a heating device that is typically located in the main body, wherein airflow through the tobacco material causes moisture in the tobacco material to be released as vapour. A vapour may be formed from a carrier in the tobacco material (this carrier may for example include propylene glycol and/or vegetable glycerin) and additionally volatile compounds released from the tobacco. The released vapour may be entrained in the airflow drawn through the tobacco.

As the vapour passes through the smoking substitute device (entrained in the airflow) from an inlet to a mouthpiece (outlet), the vapour cools and condenses to form an aerosol (also referred to as a vapour) for inhalation by the user. The aerosol will normally contain the volatile compounds.

In HNB smoking substitute devices, heating as opposed to burning the tobacco material is believed to cause fewer, or smaller quantities, of the more harmful compounds ordinarily produced during smoking. Consequently, the HNB approach may reduce the odour and/or health risks that can arise through the burning, combustion and pyrolytic degradation of tobacco.

An example of the HNB approach is the IQOS® smoking substitute device from Philip Morris Ltd. The IQOS® smoking substitute device uses a consumable, including reconstituted tobacco located in a wrapper. The consumable includes a holder incorporating a mouthpiece. The consumable may be inserted into a main body that includes a heating device. The heating device has a thermally conductive heating knife which penetrates the reconstituted tobacco of the consumable, when the consumable is inserted into the heating device. Activation of the heating device heats the heating element (in this case a heating knife), which, in turn, heats the tobacco in the consumable. The heating of the tobacco causes it to release nicotine vapour and flavourings which may be drawn through the mouthpiece by the user through inhalation.

A second example of the HNB approach is the device known as "Glo"® from British American Tobacco p.l.c. Glo® comprises a relatively thin consumable. The consumable includes leaf tobacco which is heated by a heating device located in a main body. When the consumable is placed in the main body, the tobacco is surrounded by a heating element of the heating device. Activation of the heating device heats the heating element, which, in turn, heats the tobacco in the consumable. The heating of the tobacco causes it to release nicotine vapour and flavourings which may be drawn through the consumable by the user through inhalation. The tobacco, when heated by the heating device, is configured to produce vapour when heated rather than when burned (as in a smoking apparatus, e.g. a cigarette). The tobacco may contain high levels of aerosol formers (carrier), such as vegetable glycerine ("VG") or propylene glycol ("PG").

The present inventor(s) have observed that in some cases, introduction of a consumable to the smoking substitute device can cause mechanical failure of certain parts.

The present disclosure has been devised in light of the above considerations.

SUMMARY

Accordingly, at its broadest aspects of the disclosure are concerned with a mechanical stop which prevents deformation of one or more electrical contacts.

In a first aspect, the disclosure provides a consumable for a smoking substitute device, comprising: a heating device, for heating a vapourisable liquid; an electrical contact, for connecting to a power supply terminal of the smoking substitute device to the heating device; and a boss, located adjacent to the electrical contact; wherein the boss resists physical deformation of the electrical contact when it is connected to the power supply of the smoking substitute device.

Advantageously, such a boss can improve the reliability of the consumable for the smoking substitute device, by maintaining the electrical contact in the appropriate position so that it reliably connects to the power supply terminal when the consumable is connected to the smoking substitute device.

Optional features of the disclosure will now be set out. These are applicable singly, or in any combination with any aspect of the disclosure.

The term boss may be considered equivalent to the term mechanical stop.

The boss may be located on an opposing side of the electrical contact to a side to which the power supply terminal of the smoking substitute device connects.

The boss may be located between the electrical contact and the heating device.

The boss may be a first boss, and a second boss may be provided adjacent to the electrical contact on a same side of the electrical contact to the first boss, and may be on an opposing lateral side of the electrical contact to the first boss. There may be a gap between the first boss and the second boss. Alternatively, the boss may be a single boss which extends across a width of the electrical contact.

The consumable may comprise two electrical contacts, each for connecting to a respective power supply terminal of the smoking substitute device, and may further comprise a boss for each electrical contact.

The or each boss may be integrally moulded with a housing for the heating device.

The or each electrical contact may be formed from an elongate conductor having a bend therein, such that a flat planar surface is located adjacent to the or each boss, and a further portion of the or each electrical contact may extend towards the heating device. The or each boss may be located adjacent to a region of the flat planar surface which is distal to the bend of the or each electrical contact.

In a second aspect, the disclosure provides a smoking substitute device including the consumable of the first aspect. The consumable as included in the second aspect may have any, or any combination insofar as they are compatible, of the optional features of the consumable of the first aspect.

The smoking substitute device may have a power supply terminal, which is in physical contact with the electrical contact of the consumable and thereby allows power to flow from a battery of the smoking substitute device to the heater of the consumable. The electrical contact may be directly adjacent to the boss, and directly adjacent to the power supply terminal.

BRIEF DESCRIPTION OF THE DRAWINGS

Embodiments of the disclosure will now be described by way of example with reference to the accompanying drawings in which:

FIG. 1(*b*) shows the main body of the smoking substitute device of FIG. 1(*a*) without the consumable;

FIG. 1(*c*) shows the consumable of the smoking substitute device of FIG. 1(*a*) without the main body;

FIG. 2(*b*) is a schematic view of the consumable of the smoking substitute device of FIG. 1(*b*);

DETAILED DESCRIPTION AND FURTHER OPTIONAL FEATURES

Aspects and embodiments of the present disclosure will now be discussed with reference to the accompanying figures. Further aspects and embodiments will be apparent to those skilled in the art.

Figures 1A, 1B, 1C:
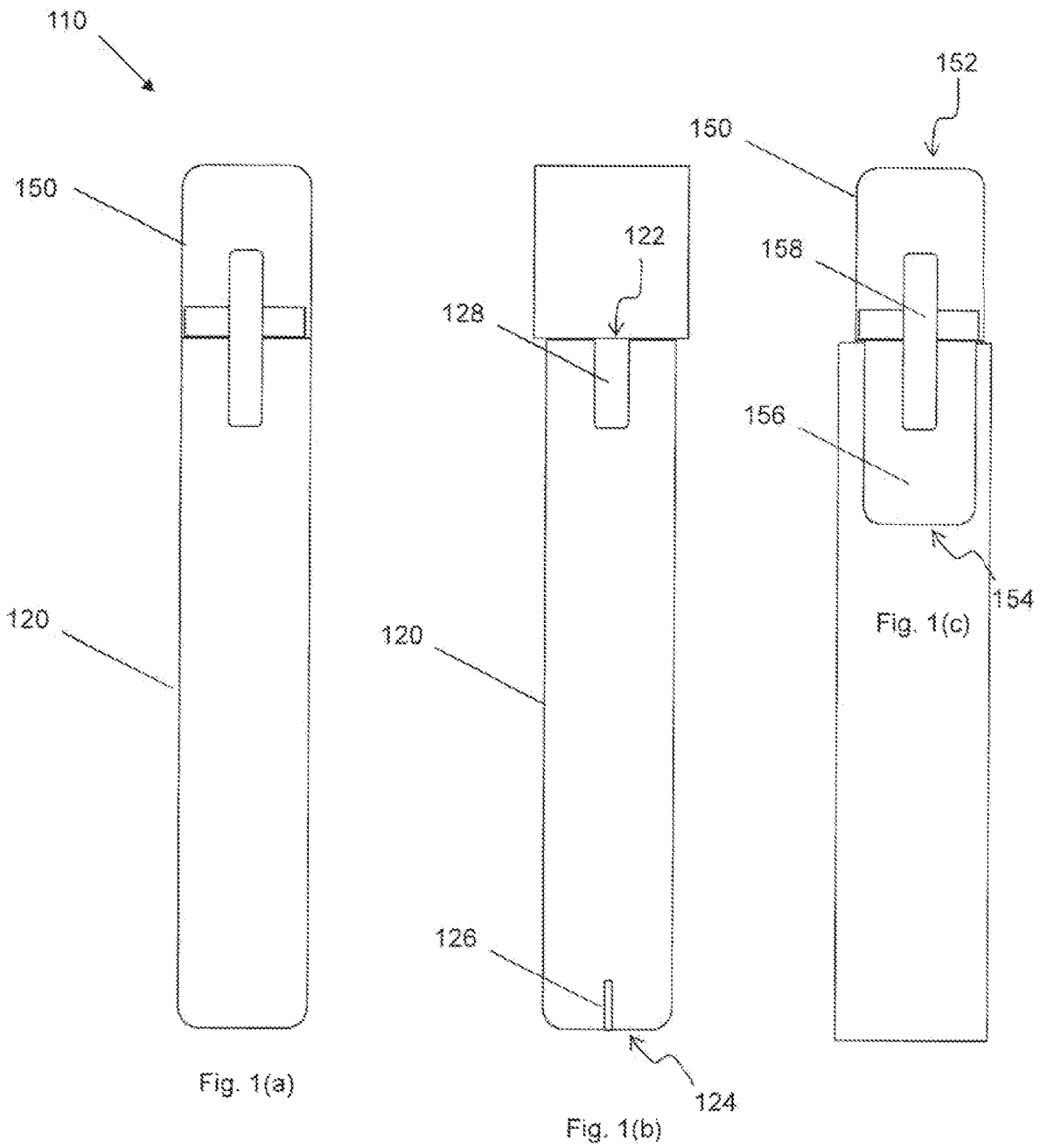
FIG. 1(*a*) shows an example smoking substitute device.

FIG. 1(*a*) shows an example smoking substitute device 110. In this example, the smoking substitute device 110 includes a main body 120 and a consumable 150. The consumable 150 may alternatively be referred to as a "pod".

In this example, the smoking substitute device 110 is a closed system vaping device, wherein the consumable 150 includes a sealed tank 156 and is intended for one-use only.

FIG. 1(*a*) shows the smoking substitute device 110 with the main body 120 physically coupled to the consumable 150.

FIG. 1(*b*) shows the main body 120 of the smoking substitute device 110 without the consumable 150.

FIG. 1(*c*) shows the consumable 150 of the smoking substitute device 110 without the main body 120.

The main body 120 and the consumable 150 are configured to be physically coupled together, in this example by pushing the consumable 150 into an aperture in a top end 122 of the main body 120. In other examples, the main body 120 and the consumable could be physically coupled together by screwing one onto the other, or through a bayonet fitting, for example. An optional light 126, e.g. an LED located behind a small translucent cover, is located a bottom end 124 of the main body 120. The light 126 may be configured to illuminate when the smoking substitute device 110 is activated.

The consumable 150 includes a mouthpiece (not shown) at a top end 152 of the consumable 150, as well as one or more air inlets (not shown in FIG. 2) so that air can be drawn into the smoking substitute device 110 when a user inhales through the mouthpiece. At a bottom end 154 of the consumable 150, there is located a tank 156 that contains e-liquid. The tank 156 may be a translucent body, for example.

The tank 156 preferably includes a window 158, so that the amount of e-liquid in the tank 156 can be visually assessed. The main body 120 includes a slot 128 so that the window 158 of the consumable 150 can be seen whilst the rest of the tank 156 is obscured from view when the consumable 150 is inserted into the aperture in the top end 122 of the main body 120.

The tank 156 may be referred to as a "clearomizer" if it includes a window 158, or a "cartomizer" if it does not.

The consumable 150 may identify itself to the main body 120, via an electrical interface, RFID chip, or barcode.

Figure 2A:
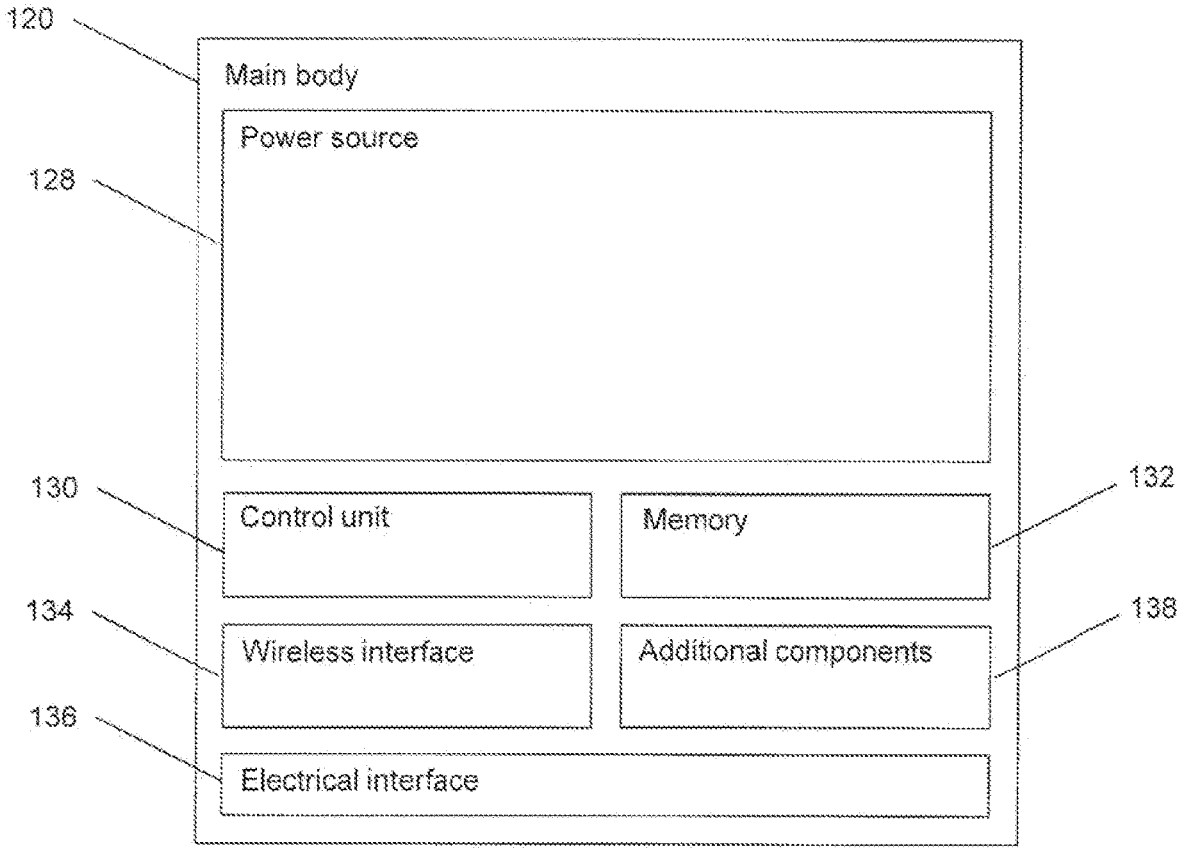
FIG. 2(*a*) is a schematic view of the main body of the smoking substitute device of FIG. 1(*a*)
Figure 2B:
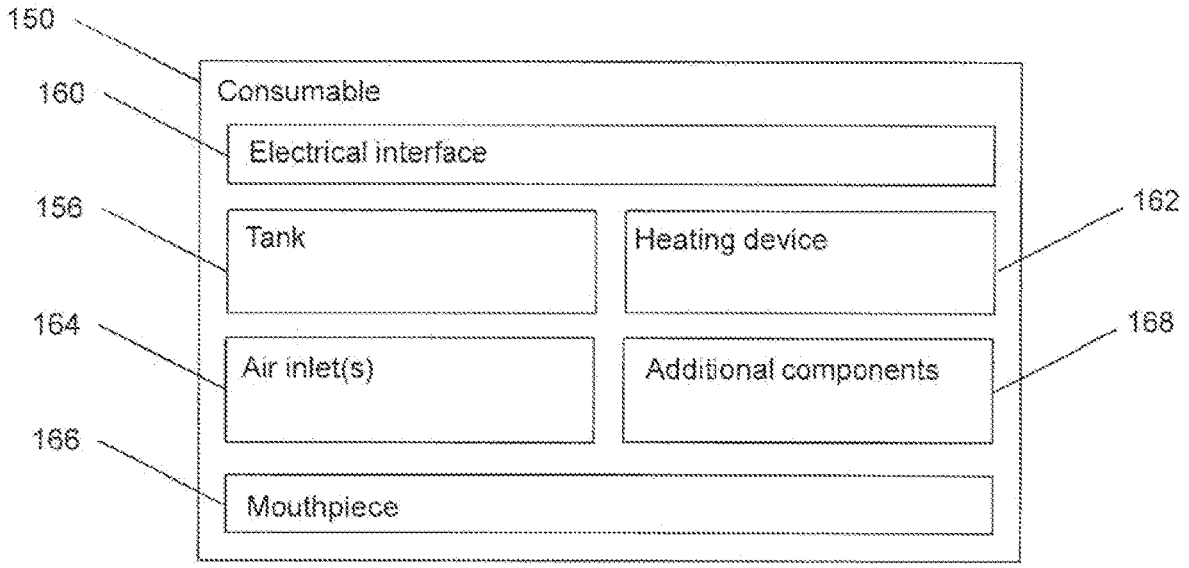

FIG. 2(*a*) is a schematic view of the main body 120 of the smoking substitute device 110.

FIG. 2(*b*) is a schematic view of the consumable 150 of the smoking substitute device 110.

As shown in FIG. 2(*a*), the main body 120 includes a power source 140, a control unit 130, a memory 132, a wireless interface 134, an electrical interface 136, and, optionally, one or more additional components 138.

The power source 140 is preferably a battery, more preferably a rechargeable battery.

The control unit 130 may include a microprocessor, for example.

The memory 132 is preferably includes non-volatile memory. The memory may include instructions which, when implemented, cause the control unit 130 to perform certain tasks or steps of a method.

The wireless interface 134 is preferably configured to communicate wirelessly with the mobile device 2, e.g. via Bluetooth®. To this end, the wireless interface 134 could include a Bluetooth® antenna. Other wireless communication interfaces, e.g. WiFi®, are also possible. As discussed above, the wireless interface 134 may be configured to communicate wirelessly with the remote server 2.

The electrical interface 136 of the main body 120 may include one or more electrical contacts. The electrical interface 136 may be located in, and preferably at the bottom of, the aperture in the top end 122 of the main body 120. When the main body 120 is physically coupled to the consumable 150, the electrical interface 136 may be configured to pass electrical power from the power source 140 to (e.g. a heating device of) the consumable 150 when the smoking substitute device 110 is activated, e.g. via the electrical interface 160 of the consumable 150 (discussed below). When the main body 120 is not physically coupled to the consumable 150, the electrical interface may be configured to receive power from the charging station 6. The electrical interface 136 may also be used to identify the consumable 150 from a list of known consumables. For example, the consumable may be a particular flavour and/or have a certain concentration of nicotine. This can be identified to the control unit 130 of the main body 120 when the consumable is connected to the main body.

Additionally, or alternatively, there may be a separate communication interface provided in the main body 120 and a corresponding communication interface in the consumable 150 such that, when connected, the consumable can identify itself to the main body 120.

The additional components 138 of the main body 120 may include the optional light 126 discussed above.

The additional components 138 of the main body 120 may, if the power source 140 is a rechargeable battery, include a charging port configured to receive power from the charging station 6. This may be located at the bottom end 124 of the main body 120. Alternatively, the electrical interface 136 discussed above is configured to act as a charging port configured to receive power from the charging station 6 such that a separate charging port is not required.

The additional components 138 of the main body 120 may, if the power source 140 is a rechargeable battery, include a battery charging control circuit, for controlling the charging of the rechargeable battery. However, a battery charging control circuit could equally be located in the charging station 6 (if present).

The additional components 138 of the main body 120 may include an airflow sensor for detecting airflow in the smoking substitute device 110, e.g. caused by a user inhaling through a mouthpiece 166 (discussed below) of the smoking substitute device 110. The smoking substitute device 110 may be configured to be activated when airflow is detected by the airflow sensor. This optional sensor could alternatively be included in the consumable 150 (though this is less preferred where the consumable 150 is intended to be disposed of after use, as in this example). The airflow sensor can be used to determine, for example, how heavily a user draws on the mouthpiece or how many times a user draws on the mouthpiece in a particular time period.

The additional components 138 of the main body 120 may include an actuator, e.g. a button. The smoking substitute device 110 may be configured to be activated when the actuator is actuated. This provides an alternative to the airflow sensor noted, as a mechanism for activating the smoking substitute device 110.

As shown in FIG. 2(*b*), the consumable 150 includes the tank 156, an electrical interface 160, a heating device 162, one or more air inlets 164, a mouthpiece 166, and, optionally, one or more additional components 168.

The electrical interface 160 of the consumable 150 may include one or more electrical contacts. The electrical interface 136 of the main body 120 and an electrical interface 160 of the consumable 150 are preferably configured to contact each other and therefore electrically couple the main body 120 to the consumable 150 when the main body 120 is physically coupled to the consumable 150. In this way, electrical energy (e.g. in the form of an electrical current) is able to be supplied from the power source 140 in the main body 120 to the heating device 162 in the consumable 150.

The heating device 162 is preferably configured to heat e-liquid contained in the tank 156, e.g. using electrical energy supplied from the power source 140. In one example, the heating device 162 may include a heating filament and a wick, wherein a first portion of the wick extends into the tank 156 in order to draw e-liquid out from the tank 156, and wherein the heating filament coils around a second portion of the wick located outside the tank 156. In this example, the heating filament is configured to heat up e-liquid drawn out of the tank 156 by the wick to produce an aerosol vapour.

The one or more air inlets 164 are preferably configured to allow air to be drawn into the smoking substitute device 110, when a user inhales through the mouthpiece 166.

In use, a user activates the smoking substitute device 110, e.g. through actuating an actuator included in the main body 120 or by inhaling through the mouthpiece 166 as described above. Upon activation, the control unit 130 may supply electrical energy from the power source 140 to the heating device 162 (via electrical interfaces 136, 166), which may cause the heating device 162 to heat e-liquid drawn from the tank 156 to produce a vapour which is inhaled by a user through the mouthpiece 166.

As an example of one of the one or more additional components 168, an interface for obtaining an identifier of the consumable may be provided. As discussed above, this interface may be, for example, an RFID reader, a barcode or QR code reader, or an electronic interface which is able to identify the consumable to the main body. The consumable may, therefore include any one or more of an RFID chip, a barcode or QR code, or memory within which is an identifier and which can be interrogated via the electronic interface in the main body.

Figure 3:
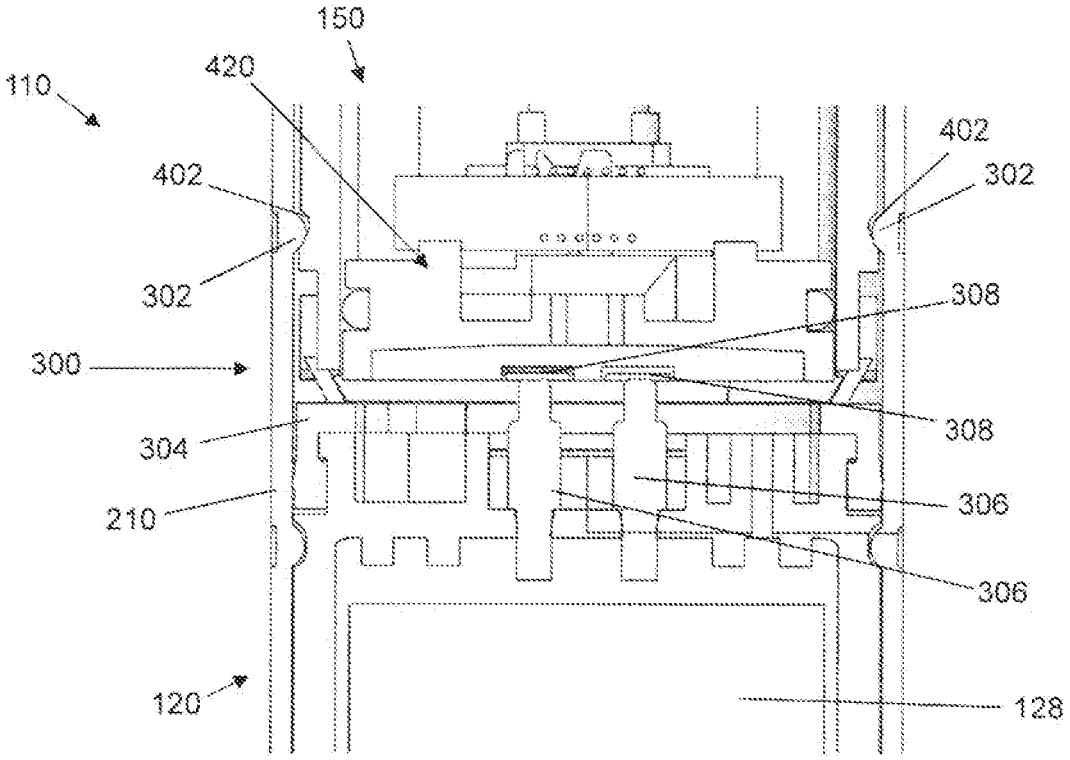
FIG. 3 is a cross-sectional view of a smoking substitute device including a consumable.

Of course, a skilled reader would readily appreciate that the smoking substitute device 110 shown in FIGS. 2 and 3 shows just one example implementation of a smoking substitute device, and that other forms of smoking substitute device could be used.

By way of example, a HNB smoking substitute device including a main body and a consumable could be used, instead of the smoking substitute device 110. One such HNB smoking substitute device is the IQOS® smoking substitute device discussed above.

FIG. 3 shows a cross-sectional view of a smoking substitute device 110 including the seal according to an embodiment of the present disclosure. Broadly, the device comprises a main body or housing 120 which has a casing 210, the main body including a connector 300 for releasably retaining, and electrically connecting to, a consumable 150. Electrical interface 136, in this example pin connectors 306 of the connector 300 connects with the respective electrical interface 160 in the consumable, in this example metal plate contacts 308, thereby allowing power from a battery 128 in the main body to be transferred to a heater in the consumable.

The metal plate contacts 308 of the consumable are formed from plates of conductive metal, which are bent through an angle of 90° at a point along their length. The metal plate contacts 308 therefore offer up flat conductive surfaces for the pin connectors 306 of the smoking substitute device, whilst also extending further into the consumable. The flat conductive surfaces are generally aligned or flush with a lower most surface of the consumable. The heater, to which the metal plate contacts 308 are electrically connected, is located within coil and wick assembly 420. The pin connectors 306 are of the 'pogo' pin variety, in that they extend away from battery 128 and protrude into where the consumable will be held. Physical connectors 302 of the connector 300 interact with corresponding fixtures 402 of the consumable 150. In this example, the physical connectors 302 are one or more protrusions which grip counterpart grooves 402 in the consumable.

Between the consumable 150 and the main body or housing 120 is a flexible seal 304 which is within the connector 300. The flexible seal in this example is situated between a lowermost surface of the consumable 150, and a surface of the main housing which includes the electrical interface 136. As will be appreciated, the consumable is introduced into connector by pushing it into a top end of the main housing, as has been discussed previously. Therefore, when inserted, the lowermost surface of the consumable compresses the flexible seal in a direction towards the battery 128.

Figure 4:
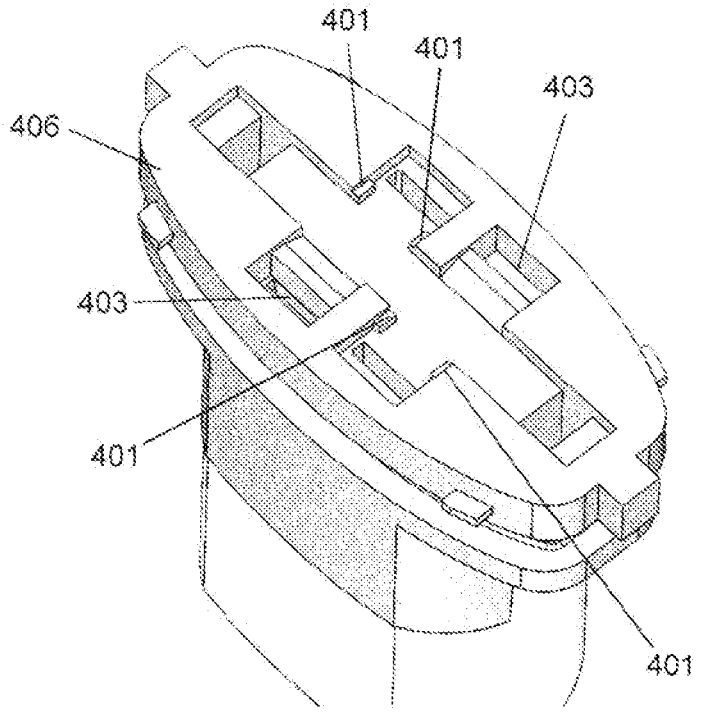
FIG. 4 is an isometric view of an end of the consumable, with the metal plate contacts removed.

FIG. 4 shows an isometric view of a bottom end of a consumable for the smoking substitute device. In use, the consumable is slid bottom end first into the connector 300 of the smoking substitute device. The pin connectors 306 of the smoking substitute device then make contact with the plate metal plate contacts 308 in the consumable. In this view, the metal plate contacts 308 of the consumable have been removed. Of note, is that below where each metal plate contact would be located are a pair of bosses 401. The bosses 401 are located on an opposing side of the consumable to a corresponding metal plate contact slot 403.

The metal plate contacts extend along the bottom most surface of the consumable from the bosses 401 to, and through, the metal plate contact slot 403. The metal plate contacts then contact with, or are integral to, a heating coil of the coil and wick assembly 420. The bosses 401 ensure that when the pin connectors 306 of the smoking substitute device contact the metal plate contacts 308 of the consumable the metal plate contacts are not forced away from the pin connectors 306.

The bosses 401 are, in this example, integrally moulded with a coil and wick holder 406, which retains the coil and wick assembly 402. The coil and wick holder is made from plastic, via an injection moulding process, but could of course be made from any suitable material. The bosses 401 protrude from a sidewall of the coil and wick holder, within a channel provided for the metal plate contacts 308.

Figure 5:
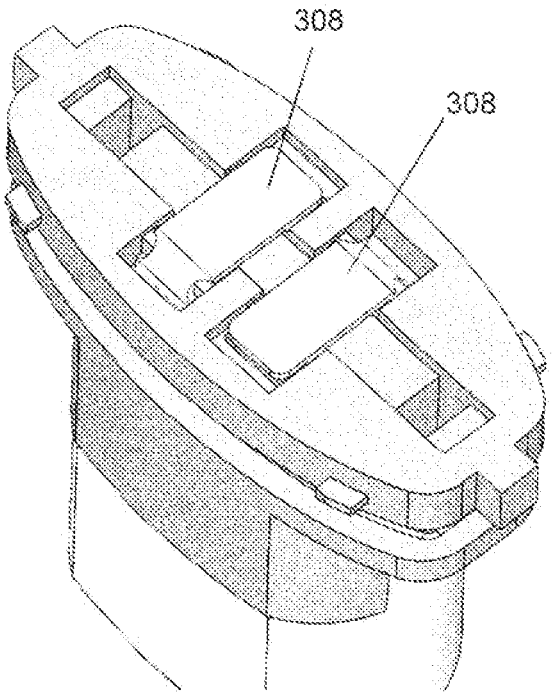
FIG. 5 is an isometric view of an end of the consumable.

FIG. 5 shows an isometric view of the consumable of FIG. 4, but including the metal contact plates 308. As can be seen, the bosses are located directly between the metal plate contacts 308 and a bottom surface of the coil and wick assembly. The metal plate contacts 308 sit within respective channels of the coil and wick holder 406, and so are flush with a lowermost surface of the consumable.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

LIST OF FEATURES

110 Smoking substitute device
120 Main body
122 Top end of main body
124 Bottom end of main body
126 Light
128 Slot
130 Control unit
132 Memory
134 Wireless interface
136 Electrical interface
138 Additional component
140 Power source
150 Consumable
152 Top end of consumable
154 Bottom end of consumable
156 Tank
158 Window
160 Electrical interface
162 Heating device
164 Air inlets
166 Mouthpiece
168 Additional components
210 Casing of main body
300 Connector
302 Physical connector in main body
304 Flexible seal
306 Pin connector
308 Metal plate contact
401 Boss
402 Groove
403 Electrical contact slot
406 Coil and wick holder
420 Coil and wick assembly

The invention claimed is:

1. A consumable for a smoking substitute device, comprising:

a heating device, for heating a vapourisable liquid;

an electrical contact, for connecting a power supply terminal of the smoking substitute device to the heating device; and a boss, located adjacent to the electrical contact, between the electrical contact and the heating device, and on an opposing side of the electrical contact to a side to which the power supply terminal of the smoking substitute device connects;

wherein the boss resists physical deformation of the electrical contact when the electrical contact is connected to the power supply terminal of the smoking substitute device.

2. The consumable of claim 1, wherein the boss is a first boss, and a second boss is provided adjacent to the electrical contact on a same side of the electrical contact to the first boss, and on an opposing lateral side of the electrical contact to the first boss.

3. The consumable of claim 1, comprising two electrical contacts, each for connecting to a respective power supply terminal of the smoking substitute device, and further comprising a boss for each electrical contact.

4. The consumable of claim 1, wherein the boss is integrally moulded with a housing for the heating device.

5. The consumable of claim 1, wherein the electrical contact is formed from an elongate conductor having a bend therein, such that a flat planar surface is located adjacent to the boss, and a further portion of the electrical contact extends towards the heating device.

6. The consumable of claim 5, wherein the boss is located adjacent to a region of the flat planar surface which is distal to the bend of the electrical contact.

7. A smoking substitute device, including the consumable of claim 1.

* * * * *